United States Patent [19]

Franz

[11] 4,106,388

[45] Aug. 15, 1978

[54] KEYBOARD UNIT FOR ELECTRONIC MUSICAL INSTRUMENTS

[75] Inventor: Reinhard Franz, Halsenbach, Fed. Rep. of Germany

[73] Assignee: WERSI-electronic GmbH & Co. Kommanditgesellschaft, Halsenbach, Fed. Rep. of Germany

[21] Appl. No.: 775,932

[22] Filed: Mar. 9, 1977

[30] Foreign Application Priority Data

Mar. 12, 1976 [DE] Fed. Rep. of Germany ..... 2610318

[51] Int. Cl.[2] ..... G10C 3/04; G10C 3/12

[52] U.S. Cl. ..... 84/434; 312/294; 312/313; 84/424

[58] Field of Search ..... 84/434, 423, 432, 436, 84/435, DIG. 17; 312/294, 313, 326, 327

[56] References Cited

U.S. PATENT DOCUMENTS

| | | | |
|---|---|---|---|
| 2,113,045 | 4/1938 | Evans | 84/DIG. 17 |
| 2,785,238 | 3/1957 | Bissonette | 84/423 |
| 2,996,941 | 8/1961 | Stiles | 84/434 |

*Primary Examiner*—L. T. Hix
*Assistant Examiner*—S. D. Schreyer
*Attorney, Agent, or Firm*—Peter K. Kontler

[57] ABSTRACT

A keyboard unit for an electronic organ wherein the bed of the housing supports two adjustably mounted bearing members which are adjacent the inner sides of the respective side walls of the housing and have round holes for posts provided in the end portions of C-bars forming part of discrete pivotable carriers for tablets, switches, stops, drawbars, keys or analogous components. The components are mounted on plate-like supports which are secured to the respective C-bars by screws extending through the slots of the respective C-bars and mating nuts non-rotatably but slidably installed in the respective C-bars. The two lowermost supports carry piano type manual keyboards, and the additional support or supports carry tablets, switches, drawbars or the like. The foremost portion of the lowermost support rests on the bed, and the foremost portion of the next-lowermost support rests on lateral panels which flank the lower keyboard and are separably and adjustably secured to the respective C-bar by additional screws and nuts. The posts are yieldably mounted in block-shaped holders which are slidable in the end portions of the respective C-bars and are held in selected positions by screws which extend through the corresponding slots.

16 Claims, 3 Drawing Figures

KEYBOARD UNIT FOR ELECTRONIC MUSICAL INSTRUMENTS

BACKGROUND OF THE INVENTION

The present invention relates to musical instruments in general, and more particularly to improvements in electronic musical instruments, especially organs. Still more particularly, the invention relates to improvements in keyboard units of organs or analogous musical instruments.

It is known to assemble the keyboard unit of a musical instrument (hereinafter called organ for short) in such a way that one or more parts thereof are movable from operative positions to second positions in which the components (e.g., keys, stops, switches or the like) on such parts are accessible for inspection, repair, adjustment or replacement. In accordance with a presently known proposal, the housing or casing of the keyboard unit supports several pivotable carriers each of which includes an elongated hollow circumferentially complete profiled member and at least one plate-like support which is secured to the respective profiled member by one or more screws and nuts and serves as a means for mounting the keys of a keyboard, switches, stops, drawbars and analogous components. The ends of the profiled members are turnably mounted in the housing. The means for turnably mounting the profiled members includes arms which are welded to the respective ends of the associated profiled members and are formed with round holes for screws which constitute fulcra and extend into the side walls of the housing. Furthermore, the end portions of each profiled member are welded to additional arms which extend forwardly and overlie shoulders or steps provided therefor on the side walls of the housing. The profiled members have a rectangular cross-sectional outline and are formed with tapped holes which are machined into two spaced-apart sections of the respective profiled members to take relatively long screws forming part of means for fastening the aforementioned plate-like supports to the associated profiled members. The exact locations of tapped holes depend on the dimensions of the supports.

The just described conventional keyboard units exhibit many advantages. Thus, all or nearly all components which are mounted in or on a support are readily accessible as soon as the support is pivoted to its second position. Such components may include electrical or electronic devices which are connected with conductors, cables or the like. However, the machining and mounting of the parts in such keyboard units must be carried out with a high degree of precision in order to insure that the visible or accessible portions of switches, keys, drawbars and analogous components will assume optimum positions with respect to each other and with respect to the housing when the keyboard unit is fully assembled. Thus, the ultimate positions of such components depend, to a large degree, on the tolerances of machining the constituents of the housing, of the carriers and the components which are secured to the supports of the carriers. Moreover, the aforementioned holes for the fulcra and the tapped bores of the profiled members must also be machined, and their positions selected, with a high degree of accuracy. The situation is aggravated if the keyboard unit forms part of an organ which is to be assembled by the purchaser, i.e., if the parts of the keyboard unit are sold in dismantled condition not unlike the parts of an erector kit. An unskilled purchaser of a dismantled keyboard unit is highly unlikely to be capable of compensating for machining tolerances and/or of drilling holes or tapped bores with a degree of accuracy which is needed to insure proper functioning of mobile components as well as an eye-pleasing appearance of the assembled unit. Another drawback of the aforedescribed keyboard units is that the profiled members and the plate-like supports of the carriers are quite heavy and bulky which presents problems in connection with packaging and shipment.

SUMMARY OF THE INVENTION

An object of the invention is to provide a novel and improved keyboard unit which can be used in electronic organs or analogous musical instruments and whose parts are constructed in such a way that they can be readily and properly assembled by unskilled or semi-skilled persons, even if such parts are not machined with a high degree of accuracy.

Another object of the invention is to provide a keyboard unit of the above outlined character with novel and improved carriers for keyboards, switches, stops, drawbars and analogous components.

A further object of the invention is to provide the keyboard unit with novel and improved means for fastening the supports to the profiled members of the respective carriers and with novel and improved fulcra for the profiled members.

An additional object of the invention is to provide a lightweight keyboard unit whose parts can be stored and shipped to customers or dealers in relatively small receptacles and whose assembly by purchasers can be carried out by resorting to simple tools.

An ancillary object of the invention is to provide a keyboard unit wherein two, more than two or all carriers can be moved from operative positions at the same time and wherein no additional parts, such as steps or shoulders on the side walls of the housings in conventional keyboard units, are needed to insure that each and every carrier can be moved, as often as desired or necessary, to or from a predetermined optimum operative position.

The invention is embodied in the keyboard unit of a musical instrument, particularly of an electronic organ. The keyboard unit comprises a housing having a bed and spaced-apart first and second side walls which extend upwardly from the bed, substantially plate-like first and second bearing members provided in the housing adjacent the respective side walls, screws (which pass through elongated slots of the bearing members) or analogous means for adjustably securing the bearing members to the housing (preferably to the bed), and a plurality of carriers disposed between the bearing members and each including an elongated hollow profiled member (e.g., a C-rail) having first and second end portions adjacent the respective bearing members and an elongated slot which preferably extends all the way between the ends of the profiled member, at least one substantially plate-like support for keys, stops, drawbars or analogous components of the type normally found in a keyboard unit and actuatable by the fingers of the player, and means for adjustably fastening the support to the profiled member including at least one screw or an analogous externally threaded member extending through the support and the slot of the profiled member and a nut or an analogous internally threaded member which is non-rotatably received in and is slidable lengthwise of the profiled member and mates with the externally threaded member. The keyboard unit further comprises means for pivotally securing the end portions of the profiled members to the respective bearing members; such securing means preferably comprises blocks or analogous holders which are slidably received in the end portions of the profiled members, complementary male and female pivot elements for each holder (one pivot element is provided in the respective bearing member and may constitute a round hole, and the other pivot element is provided in or on the respective holder and may constitute a spring-biased post which extends into the associated hole), and screws or analogous means for adjustably connecting the holders to the respective profiled members (the shanks of such screws extend through the slots of the respective profiled members and into tapped holes of the adjacent holders).

The profiled members are parallel to each other and are preferably mounted at different levels and at different distances from the front portion of the bed.

The novel features which are considered as characteristic of the invention are set forth in particular in the appended claims. The improved keyboard unit itself, however, both as to its construction and the mode of assembling the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
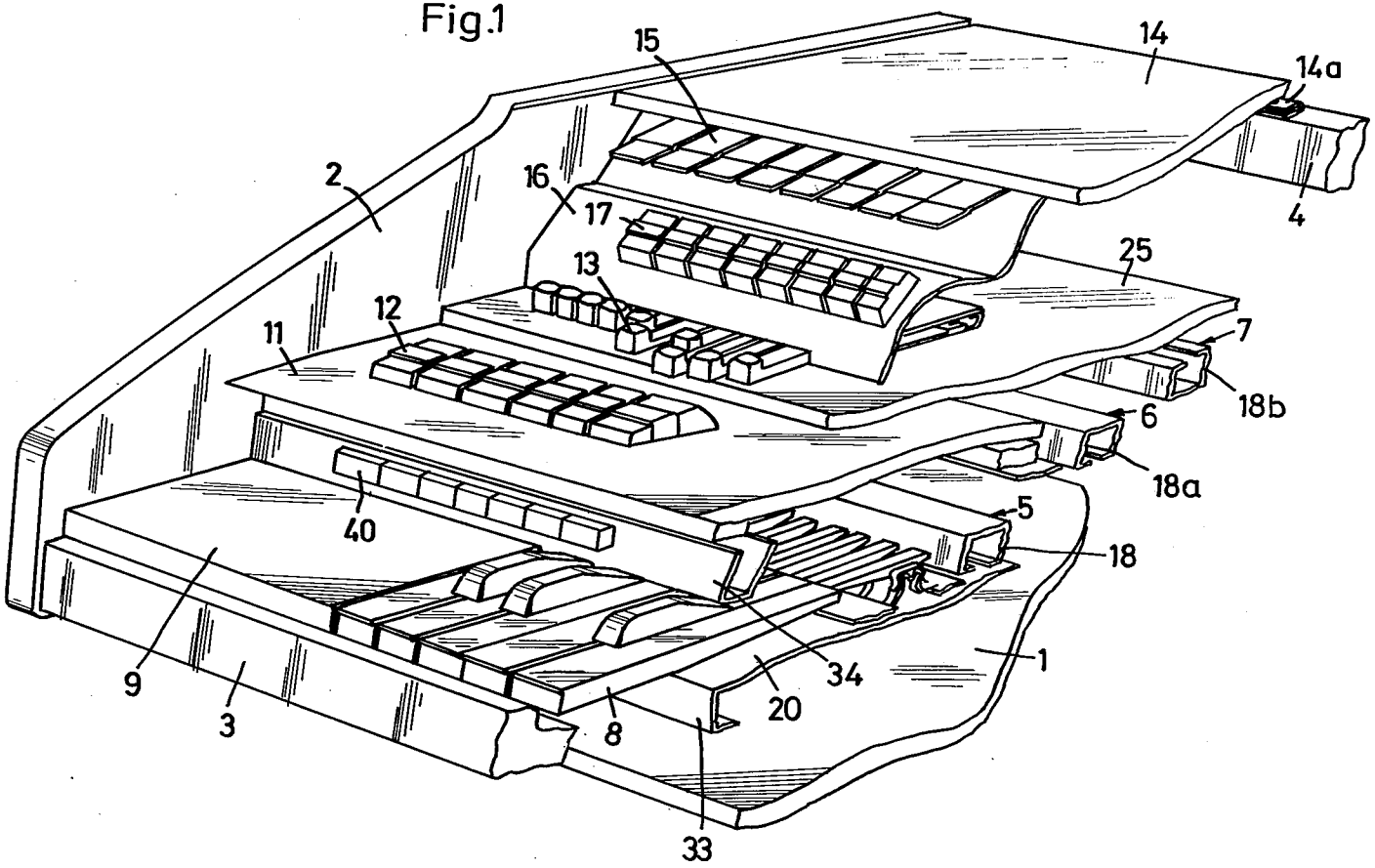
FIG. 1 is a fragmentary perspective view of a keyboard unit which forms part of an electronic organ and embodies one form of the invention, all of the carriers being shown in their operative positions.

FIG. 1 shows a portion of the keyboard unit in an electronic organ. The keyboard unit has two manual keyboards. The illustrated structure includes a casing or housing having a base plate or key bed 1, two side members or side walls 2 (one shown in FIG. 1) which flank the key bed 1 and extend upwardly therefrom, a front molding or strip 3 which extends between the side walls 2 along the front edge face of the bed 1, and a connecting member or traverse 4 which extends between the upper rear portions of the side walls 2. The housing contains three pivotable carriers 5, 6 and 7 which are disposed at different levels and at different distances from the molding 3. The foremost and lowermost carrier 5 supports a lower manual piano type keyboard 8 and includes two plate-like lateral panels 9 each disposed between one marginal portion of the keyboard 8 and the respective side wall 2. The next or median carrier 6 supports an upper manual piano type keyboard 10 (see FIG. 3) and includes two plate-like lateral panels 11 which may but need not carry selector switches 12. The rearmost and uppermost carrier 7 supports drawbars or knobs 13. A cover or lid 14 is pivotally secured to the traverse 4 by a hinge **14*a* and carries a set of tiltable tablets 15. A front wall 16, which is rigid with the cover 14, supports a set of additional switches 17**.

Figure 2:
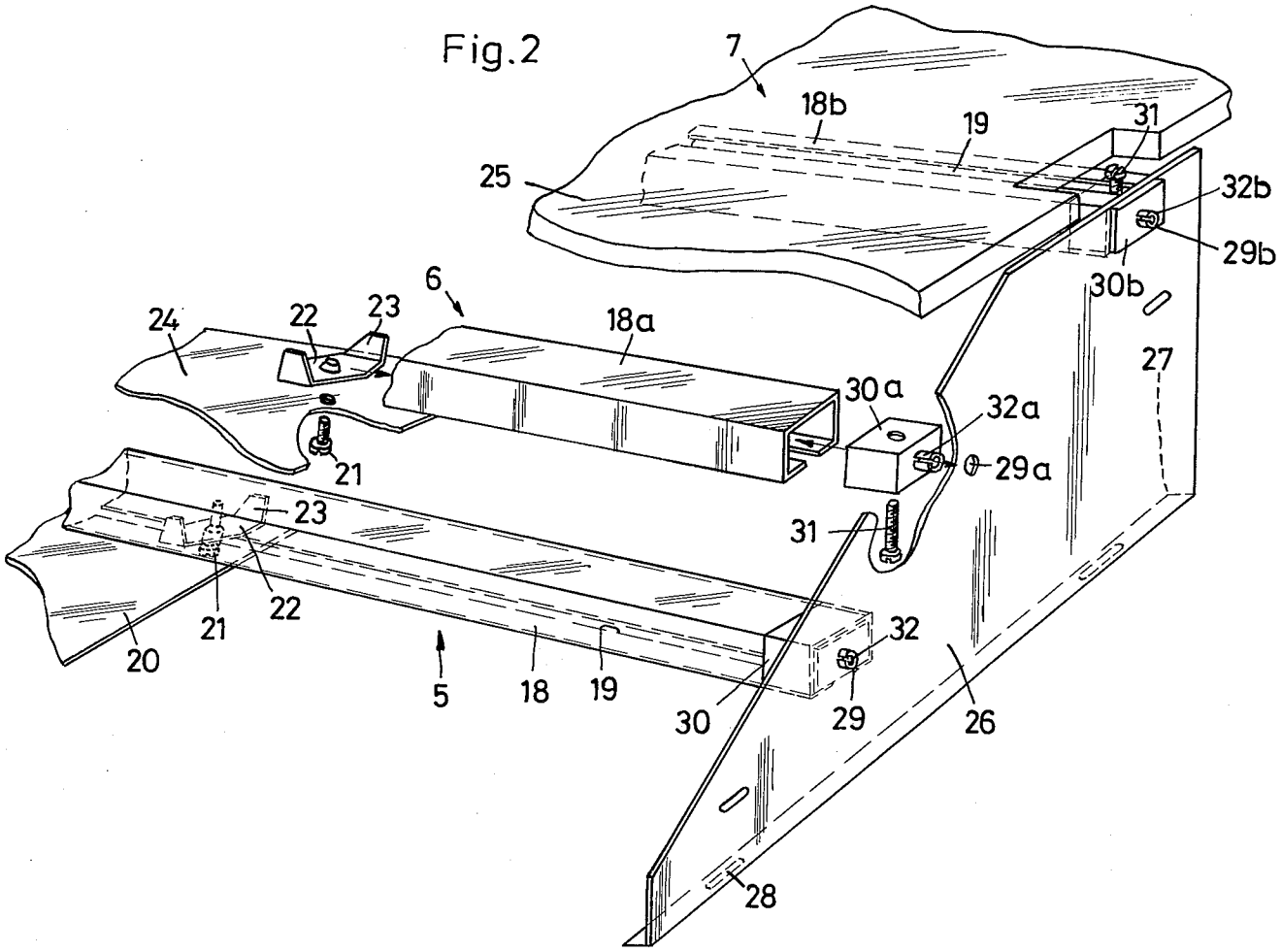
FIG. 2 is a partly exploded perspective view of certain details of the keyboard unit of FIG. 1.

FIG. 2 shows that the carrier 5 comprises an elongated hollow profiled member 18 having a square or rectangular cross-sectional outline (such profiled members are known as or may be called C-bars). The lower section or wall of the profiled member 18 is formed with an elongated slot 19 of constant width. Such profiled members can be obtained by subdividing commercially available continuous profiled (e.g., extruded) standard metallic bar stock into portions of desired length. The profiled member 18 carries a plate-like support 20 for the lower manual keyboard 8, and the support 20 is separably and adjustably but fixedly secured to the profiled member 18 by one or more fastening means each including an externally threaded member or screw 21 whose head is located below the lower section of the member 18 and whose externally threaded shank extends upwardly through the slot 19 and meshes with complementary threads in the tapped bore or hole of an internally threaded member here shown as a wing nut 22 located in the interior of the profiled member 18 and having upwardly extending lugs or ears 23 abutting against the inner sides of the front and rear sections of the member 18 so that the nut 22 can slide lengthwise of but cannot rotate in the member 18. It is clear that each nut 22 can be provided with a single lug 23 or that it suffices if the nut is formed with a suitably configurated edge face which abuts against the front or rear section of the profiled member 18, as long as the nut is held against rotation and can be clamped to the bottom section of the member 18 by tightening the respective screw 21.

The profiled member 18 further carries plate-like supports (not specifically shown but corresponding to the support 20) which carry the lateral panels 9 and are preferably adjustably secured to the member 18 by screws and nuts 21, 22 or analogous fastening means.

The carrier 6 comprises an elongated profiled member **18*a* which is preferably identical with the member 18 and is separably and adjustably connected with a plate-like support 24 for the upper manual keyboard 10. FIG. 2 merely shows one fastening means including a screw 21 and a nut 22 having two lugs 23. The profiled member 18*a* further carries additional plate-like supports (not shown) for the respective lateral panels 11; such plate-like supports are preferably secured to the member 18*a* by fastening means including screws 21 and nuts 22**.

The uppermost carrier 7 comprises an elongated profiled member **18*b* which is preferably identical with the members 18, 18*a* except that the slot 19 is provided in its upper section because the plate-like support 25 (this support may be made of wood in contrast to the supports 20 and 24 which may consist of sheet metal) is located at a level above the member 18*b*. The means for adjustably fastening the support 25 to the profiled member 18*b* preferably includes screws and nuts corresponding to the parts 21, 22. The support 25 carries the drawbars or knobs 13**.

The means for pivotally mounting the carriers 5, 6 and 7 in the housing including the bed 1, side walls 2, molding 3 and traverse 4 comprises two plate-like metallic bearing members 26 which are inwardly adjacent the respective side walls 2 and have relatively narrow lower end portions or flanges 27 extending inwardly from the respective side walls and provided with elongated slots 28. The bearing members 26 are immediately adjacent the inner sides of the respective side walls 2 and their flanges 27 rest directly on the upper side of the bed 1. Screws **28*a* or analogous connecting means are used to separably and adjustably secure the bearing members 26 to the bottom wall 1; the shanks of screws 28***a* extend through the respective slots 28. The bearing members 26 preferably consist of sheet metal and each thereof has three female pivot elements here shown as round bores or holes 29, 29*a*, 29*b* bounded by surfaces which constitute journals for yieldable complementary male pivot elements or posts 32, 32*a*, 32*b*. The posts 32, 32*a*, 32*b* are respectively installed in block-shaped holders 30, 30*a*, 30*b* which are slidably received in the respective end portions of the profiled members 18, 18*a*, 18*b*. The configuration of each block-shaped holder is such that it is readily slidable in the interior and lengthwise of the corresponding profiled member 18, 18*a*, 18*b* but cannot be tilted or otherwise reoriented therein. Screws or analogous elements 31 are utilized to maintain the holders 30, 30*a* and 30*b* in selected positions, as considered in the axial direction of the respective profiled members 18, 18*a*, 18*b*. Each holder has an outer side which faces the respective bearing member 26 and is formed with a centrally located socket for the corresponding yieldable post 32, 32*a*, 32*b*. For example, each post can be biased outwardly by a suitable helical spring (not specifically shown) but is capable of moving axially against the opposition of such spring during movement into register with the corresponding hole 29, 29*a* or 29*b*. The common axis of posts on the holders in each of the profiled members 18, 18*a*, 18*b* preferably coincides with the central longitudinal axis of the respective profiled member.

The posts 32–32*b* constitute very simple but highly satisfactory male pivot elements; they can be mounted in the respective holders in a simple and time-saving manner. Such posts (each of which may constitute a short piece of metallic or plastic tubing) can stand long periods of use since the carriers in a fully assembled keyboard unit are not expected to be pivoted from operative positions at frequent intervals. The mounting of posts 32–32*b* in such a way that their axes coincide with the central longitudinal axes of the respective profiled members 18–18*b* renders it possible to utilize relatively short holders 30–30*b* because the holders are not subjected to excessive tilting forces.

FIG. 1 shows that the front portion of the plate-like support 20 for the lower manual keyboard 8 is provided with or is rigidly connected to a suitably bent elongated (profiled) abutment portion or leg 33 which rests on the upper side of the bed 1. If desired, the lowermost portion of the leg 33 can be separably but fixedly secured to the bed 1 by one or more screws 33*a* (see FIG. 3) or analogous fasteners.

The front part of the plate-like support 24 for the upper manual keyboard 10 is provided with or is rigidly connected to an elongated U-shaped abutment portion or leg 34 (also shown in FIG. 1) which constitutes a shield and rests on the lateral panels 9. The channel which is defined by the portion 34 is open at its upper side and can receive one or more electric conductors or cables 35 (see FIG. 3). If desired, the portion 34 can be fixedly but separably secured to the lateral panels 9 by screws (not shown) or analogous fasteners corresponding to the screw 33*a* shown in FIG. 3.

The portions 33, 34 insure that the corresponding supports 20, 24 invariably assume identical operative positions whenever the portion 33 rests on the bed 1 and the portion 34 rests on the panels 9. The support 25 rests on lateral panels which are secured to the profiled member 18*a*. Thus, the side walls 2 of the housing need not be provided with shoulders, steps or similar projections in order to insure that the supports of each carrier can be moved to identical operative positions as often as desired or necessary. Such projections (which are used in the housings of conventional keyboard units) must be machined with a high degree of precision; moreover, the projections cannot guarantee reproducible movements of carriers to operative positions because they are likely to be deformed in response to heating, cooling or changes of moisture content of the material of the housing.

Fastening of portions 33 and 34 in operative positions of the respective carriers (note the screw 33*a* in FIG. 3) is often desirable or necessary, e.g., when the improved keyboard unit forms part of a portable organ or a similar portable musical instrument. It is preferred to provide the supports 20 and 24 with portions 33, 34 whose length equals or approximates the length of the corresponding profiled members 18, 18*a*. This insures that the supports 20, 24 are adequately located or positioned substantially all the way between the bearing members 26.

The utilization of a portion 34 which constitutes a shield above the lower keyboard 8 is desirable and advantageous because this renders it possible to employ relatively simple lateral panels 9, i.e., such panels need not be provided with upwardly extending portions to close the gap between the manuals 8 and 10. If the keyboard unit comprises three keyboards, the front portion of the support for the uppermost keyboard is preferably similar to or identical with the portion 34.

FIG. 1 shows that the portion 34 of the support 24 can carry additional switches, stops, keys, bus bars or analogous components 40. Portions of such components extend into the interior of the portion 34.

Figure 3:
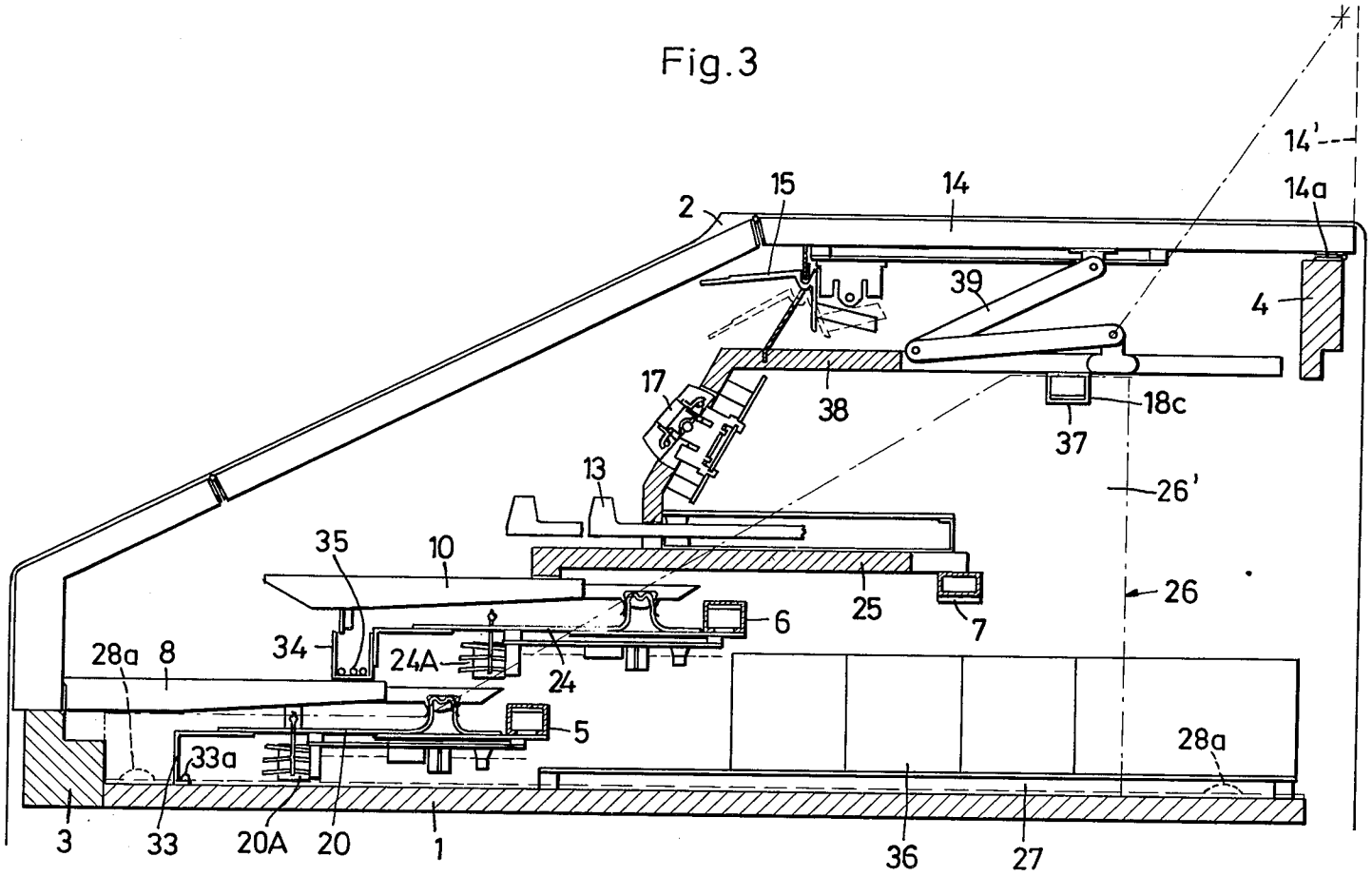
FIG. 3 is a transverse vertical sectional view of a modified keyboard unit.

FIG. 3 shows the upper portion of a modified keyboard unit. All such parts of this unit which are identical with or clearly analogous to corresponding parts of the unit shown in FIGS. 1 and 2 are denoted by similar reference characters. The plate-like supports 20 and 24 of FIG. 3 carry additional components, such as electric switches and/or plates which latter support electrical and/or electronic components of the musical instrument. One of the switches at the underside of the support 20 is shown at 20A, and one of the switches at the underside of the support 24 is shown at 24A. Additional electronic components, such as a tone generator 36, are mounted at the upper side of the bed 1.

The two bearing members 26 (only one shown in FIG. 3) have upwardly projecting portions or extensions 26′ which support a further carrier 37 including an elongated profiled member 18*c* here shown as having a polygonal (preferably rectangular or square) cross-sectional outline and provided with a longitudinally extending slot. The profiled member 18*c* is rigid with a plate-like support 38. The cover 14 can be pivoted (about the axis defined by the hinge 14*a*) independently of the support 38 and can be held in the raised position (indicated by broken lines, as at 14′) by a collapsible linkage 39 which is articulately connected to the underside of the cover as well as to the support 38. When the cover 14 is moved to the open or raised position 14′, the support 38 can be pivoted about the axis defined by the posts (not shown) in the holders received in the end portions of the profiled member 18*c* and extending into registering holes in the extensions 26′ of the bearing members 26. This renders it possible to gain access to the components (such as the switches 17) which are mounted on the support 38. The cover 14 carries the tablets 15 which, too, are readily accessible when the cover is moved to the raised position 14'.

It will be noted that the profiled member 18*c* is mounted at a level above and behind the profiled member 18*b* of the carrier 7; this insures that all of the supports 20, 24, 25, 38 and the cover 14 may be pivoted to or from the illustrated operative positions (together with the associated profiled members) simultaneously and without any interference with each other. Such mounting of the supports has been found to contribute significantly to convenient access to all components (keys, switches, drawbars, tablets and others) which are secured to and/or movable in the respective supports.

The improved keyboard unit (whose component parts can be purchased in dismantled condition not unlike the parts of an erector kit) is assembled as follows:

The bearing members 26 are secured to the bed 1 in immediate proximity to the inner sides of the respective side walls 2 but in such a way that they can be shifted forwardly or rearwardly, if necessary (see the elongated slots 28 in the flange 27 of the bearing member 26 shown in FIG. 2). The supports 20, 24, 25 and 38 are adjustably secured to the respective profiled members 18, 18*a*, 18*b* and 18*c*. The holders (including the holders 30, 30*a* and 30*b* are inserted into the end portions of the respective profiled members so that their posts cannot interfere with the placing of such profiled members between the bearing members 26, i.e., the posts are located in the respective profiled members or extend only slightly beyond the respective ends of such members. The lowermost carrier 5 is inserted between the bearing members 26 prior to other carriers and its holders 30 are moved outwardly so that the yieldable posts 32 extend into the adjacent holes 29. The screws 31 are thereupon applied to fix the holders 30 with respect to the profiled member 18 in such a way that the posts 32 continue to extend into and are pivotable in the respective holes 29. The portion or leg 33 of the support 20 comes to rest on the bed 1. The bearing members 26 are then shifted (if necessary) in the longitudinal direction of the respective flanges 27 so as to insure that the front edges of keys constituting the lower keyboard 8 are flush with the molding 3. The screws 28*a* which secure the bearing members 26 to the bed 1 are then driven home to fix the bearing members in the selected final positions. If necessary, the support 20 and/or the lateral panels 9 can be shifted lengthwise of the profiled member 18 before the corresponding screws and nuts 21, 22 are applied to hold the parts 20 and 9 in their optimum positions.

The carriers 6, 7 and 37 are thereupon mounted in the bearing members 26 in similar fashion, one after the other, preferably in the following sequence: first the carrier 6, then the carrier 7 and finally (in the embodiment of FIG. 3) the carrier 37. The bearing members 26 need not be adjusted again because, once the carrier 5 is properly mounted therebetween, the remaining carriers are properly mounted as soon as their posts extend into the registering holes of the bearing members. The fastening means which secure the supports and lateral panels (if any) to the respective profiled members 18*a*, 18*b*, 18*c* can be tightened upon appropriate adjustment (if necessary) of such parts longitudinally of the associated profiled members.

The improved keyboard unit exhibits many important advantages. Thus, any manufacturing tolerances can be readily compensated for by appropriate adjustment of bearing members 26 relative to the bed 1 of the housing and/or of the supports and lateral panels relative to the associated profiled members. Moreover, many parts (such as the plate-like supports, profiled members and/or others) may be made of commercially available metallic, synthetic plastic or other material and of prefabricated standard stock which is merely cut to size and provided with holes or sockets with a high degree of accuracy by resorting to stamping, drilling, tapping or other well known techniques. When the parts of the improved keyboard unit are dismantled, they can be stored and shipped in a small crate, box or other suitable receptacle. Moreover, the weight of all or nearly all parts is low and, therefore, the overall weight of the entire kit is surprisingly low. This is attributable, to a considerable extent, to the utilization of hollow lightweight slotted profiled members.

The parts of the improved keyboard unit can be crated or boxed in fully or partly dismantled condition, depending on the desired size and/or shape of the receptacle. For example, the carriers can be inserted into boxes or crates in fully or partly assembled condition, and the same applies for the parts of the housing.

It is further within the purview of the invention to utilize identical parts (such as the profiled members 18–18*b* or 18–18*c*) in different types of keyboard units. For example, if each of the manuals 8 and 10 comprises four octaves, the respective keyboard unit will be furnished with relatively wide lateral panels. Such panels will be narrower if each keyboard comprises a higher number of octaves (e.g., five). This does not affect the convenience of assembly since the supports for the keyboards and lateral panels can be readily shifted lengthwise of the respective profiled members prior to tightening of the corresponding fastening means 21, 22. The profiled members are preferably interchangeable, e.g., the member 18 can carry the support 24, 25 or 38. Furthermore, the number of carriers can be increased to five or more or reduced to less than three, depending on the number of keyboards (for example, the unit may comprise a lower, a median and an upper piano type manual keyboard).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In a musical instrument, a keyboard unit comprising a housing having a bed and spaced-apart first and second side walls extending upwardly from said bed; substantially plate-like first and second bearing members provided in said housing adjacent the respective side walls; means for adjustably securing said bearing members to said housing; a plurality of carriers disposed between said bearing members and each including an elongated hollow profiled member having first and second end portions adjacent the respective bearing members and an elongated slot, at least one substantially plate-like support for keys, switches, stops, drawbars or analogous components, and means for adjustably fastening said support to said profiled member including at least one externally threaded member extending through said support and the slot of said profiled member and an internally threaded member non-rotatably received in and slidable lengthwise of said profiled member and mating with said externally threaded member, the profiled members of said carriers being substantially parallel to each other; and means for pivotally securing the end portions of said profiled members to the respective bearing members.

2. A keyboard unit as defined in claim 1, wherein said means for pivotally securing comprises holders slidably received in the end portions of said profiled members, complementary male and female pivot elements for each holder, one of said pivot elements being provided in the respective bearing member and the other of said pivot elements being provided in the respective holder, and means for adjustably connecting said holders to the respective profiled members, said connecting means extending through the slots of the respective profiled members.

3. A keyboard unit as defined in claim 2, wherein said bearing members consist of sheet metal and said female pivot elements include round holes in said bearing members.

4. A keyboard unit as defined in claim 2, wherein said connecting means have external threads mating with internal threads provided in the respective holders.

5. A keyboard unit as defined in claim 1, wherein said means for pivotally securing defines pivot axes coinciding with the central longitudinal axes of the respective profiled members.

6. A keyboard unit as defined in claim 1, wherein said bearing members have portions which abut against said bed.

7. A keyboard unit as defined in claim 1, wherein each of said supports is pivotable, together with the respective profiled member, to and from an operative position and one of said supports comprises a portion which abuts against said bed in the operative position of said one support.

8. A keyboard unit as defined in claim 7, wherein the length of said portion of said one support at least approximates the length of the respective profiled member.

9. A keyboard unit as defined in claim 7, further comprising means for separably securing said portion of said one support to said bed.

10. A keyboard unit as defined in claim 1, wherein each of said supports is pivotable, together with the respective profiled member, to and from an operative position, one of said carriers further comprising at least one panel secured to the corresponding profiled member and laterally adjacent the respective support, the support of another of said carriers having a portion which abuts against said panel in the operative position of said last mentioned support.

11. A keyboard unit as defined in claim 10, further comprising means for separably securing said last mentioned support to said panel.

12. A keyboard unit as defined in claim 10, wherein the length of said portion of said last mentioned support at least approximates the length of the respective profiled member.

13. A keyboard unit as defined in claim 10, wherein said portion of said last mentioned support has a substantially U-shaped cross-sectional outline.

14. A keyboard unit as defined in claim 10, wherein said portion of said last mentioned support is hollow and further comprising at least one conductor in said hollow portion.

15. A keyboard unit as defined in claim 1, wherein said carriers include an upper carrier and a lower carrier, said components on the support of said lower carrier constituting a first manual keyboard and said components on the support of said upper carrier constituting a second manual keyboard, said supports and the respective profiled members being pivotable to and from operative positions and the support of said upper carrier including a shield which rests on said lower carrier in said operative position of said last mentioned support.

16. A keyboard unit as defined in claim 15, further comprising additional components mounted in said shield.

* * * * *